US009857095B2

(12) United States Patent
Hirakawa et al.

(10) Patent No.: US 9,857,095 B2
(45) Date of Patent: Jan. 2, 2018

(54) INDOOR UNIT FOR AIR-CONDITIONING APPARATUS WITH AIRFLOW BLOCKING PORTION FOR INFRARED SENSOR

(71) Applicant: Mitsubishi Electric Corporation, Tokyo (JP)

(72) Inventors: Seiji Hirakawa, Tokyo (JP); Hidetomo Nakagawa, Tokyo (JP); Nobutaka Tanabe, Tokyo (JP); Motoshi Tezuka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 186 days.

(21) Appl. No.: 14/813,463

(22) Filed: Jul. 30, 2015

(65) Prior Publication Data

US 2016/0033162 A1 Feb. 4, 2016

(30) Foreign Application Priority Data

Aug. 4, 2014 (JP) ..... 2014-158771

(51) Int. Cl.
*F24F 11/00* (2006.01)
*F24F 13/20* (2006.01)

(52) U.S. Cl.
CPC ..... *F24F 13/20* (2013.01); *F24F 11/0034* (2013.01); *F24F 2011/0035* (2013.01); *F24F 2013/207* (2013.01)

(58) Field of Classification Search
CPC ..... F24F 13/20; F24F 11/0034; F24F 2011/0035; F24F 2013/207; F24F 1/0011
See application file for complete search history.

(56) References Cited

U.S. PATENT DOCUMENTS 4,671,458 A * 6/1987 Fukuda ..... F24F 11/0009 165/237
2002/0172588 A1* 11/2002 Ikeda ..... F04D 17/04 415/53.1

(Continued)

FOREIGN PATENT DOCUMENTS

JP 2010-270956 A 12/2010
JP 2013-170763 A 9/2013

(Continued)

OTHER PUBLICATIONS

Extended European Search Report dated Dec. 4, 2015 in the corresponding EP application No. 15179581.2.

(Continued)

*Primary Examiner* — Travis Ruby
(74) *Attorney, Agent, or Firm* — Posz Law Group, PLC

(57) ABSTRACT

In an indoor unit for an air-conditioning apparatus, a casing has an air inlet formed in an upper part and an air outlet formed below a front part. The casing accommodates a heat exchanger and fan. A horizontal airflow-direction louver is mounted pivotally inside the air outlet to guide airflow in a horizontally changeable manner. A vertical airflow-direction louver is mounted to cover the air outlet in a closed position and to guide airflow in a vertically changeable manner. An infrared sensor projects downward from the casing at a position in a horizontal end portion of the casing and in front of the air outlet. An airflow blocking portion is located behind the infrared sensor, and has a side wall on or beside one edge of the air outlet. The side wall is located closer to a center of the air outlet in the horizontal direction than the infrared sensor.

8 Claims, 6 Drawing Sheets

(56) References Cited

U.S. PATENT DOCUMENTS

| | | | | |
|---|---|---|---|---|
| 2003/0167786 | A1* | 9/2003 | Nakagawa | F24F 1/0007 62/285 |
| 2012/0012297 | A1* | 1/2012 | Nakagawa | F24F 11/0012 165/247 |

FOREIGN PATENT DOCUMENTS

| | | | |
|---|---|---|---|
| KR | 20100111964 | A | 10/2010 |
| WO | 2006061974 | A1 | 6/2006 |
| WO | 2010117142 | A2 | 10/2010 |

OTHER PUBLICATIONS

Communication pursuant to Article 94(3) dated Mar. 29, 2017 in the corresponding EP application No. 15179581.2.

* cited by examiner

INDOOR UNIT FOR AIR-CONDITIONING APPARATUS WITH AIRFLOW BLOCKING PORTION FOR INFRARED SENSOR

TECHNICAL FIELD

The present invention relates to an indoor unit for an air-conditioning apparatus.

BACKGROUND ART

A related-art indoor unit for an air-conditioning apparatus is known that includes a sensor to detect a state of a human or other objects. The sensor is arranged on any one of horizontal end portions of a front part of a casing (see, for example, Patent Literature 1).

CITATION LIST

Patent Literature

Patent Literature 1: Japanese Unexamined Patent Application Publication No. 2010-270956 (page 6 to page 9, FIG. 1)

SUMMARY OF INVENTION

Technical Problem

The related-art indoor unit for an air-conditioning apparatus involves potential problem of blocking a sensing field of the sensor by a vertical airflow-direction louver provided to an air outlet of the indoor unit, or problem of blowing on the sensor by the conditioned air from the air outlet. Where the sensor under this condition detects a temperature of a target, a position of a human body, or other factors, the temperature of the target, the position of the human, or the like detected or recognized, may be erroneous, problematically.

The present invention has been made to overcome the problem described above, and an object of the present invention is to provide an indoor unit for an air-conditioning apparatus, capable of preventing interruption of a sensing field of an infrared sensor by a casing of the indoor unit or a vertical airflow-direction louver of the indoor unit and preventing conditioned air from blowing on the infrared sensor.

Solution to Problem

According to one embodiment of the present invention, there is provided an indoor unit for an air-conditioning apparatus, including: a casing having an air inlet formed in an upper part of the casing and an air outlet formed below a front part of the casing, the casing including a heat exchanger and a fan provided therein; horizontal airflow-direction louvers installed inside the air outlet and configured to variably change a direction of airflow from the air outlet in a horizontal direction; vertical airflow-direction louvers installed to cover the air outlet and configured to variably change the direction of the airflow from the air outlet in a vertical direction; an infrared sensor provided on one end of the casing in the horizontal direction at a position closer to the front part than a position of the air outlet of the casing to project downward; and an airflow blocking portion provided close to a back of the casing with respect to the infrared sensor located close to the front part, the airflow blocking portion having a side wall on one end side of the air outlet, in which the side wall of the airflow blocking portion is located closer to a center of the air outlet in the horizontal direction than the infrared sensor.

Advantageous Effects of Invention

According to the one embodiment of the present invention, the airflow of the conditioned air from the air outlet is directed away from the infrared sensor by the side wall of the airflow blocking portion. Therefore a sensor cover, for example, which covers the infrared sensor, is allowed to retain a temperature substantially equal to a room temperature. Hence, the infrared sensor can detect a precise amount of infrared ray without being disturbed by the temperature of the sensor cover. Accordingly, the infrared sensor can obtain precise information about a floor temperature, a wall surface temperature, a position of a human body, and an activity status of the human.

Further, the infrared sensor projects downward from the casing at a position in a horizontal end portion of the casing and in front of the air outlet. Therefore, a sensing field of the infrared sensor is not interrupted by the vertical airflow-direction louvers or the casing itself. With this configuration, an extend range of detection by the infrared sensor results.

DESCRIPTION OF EMBODIMENTS

Figure 1:
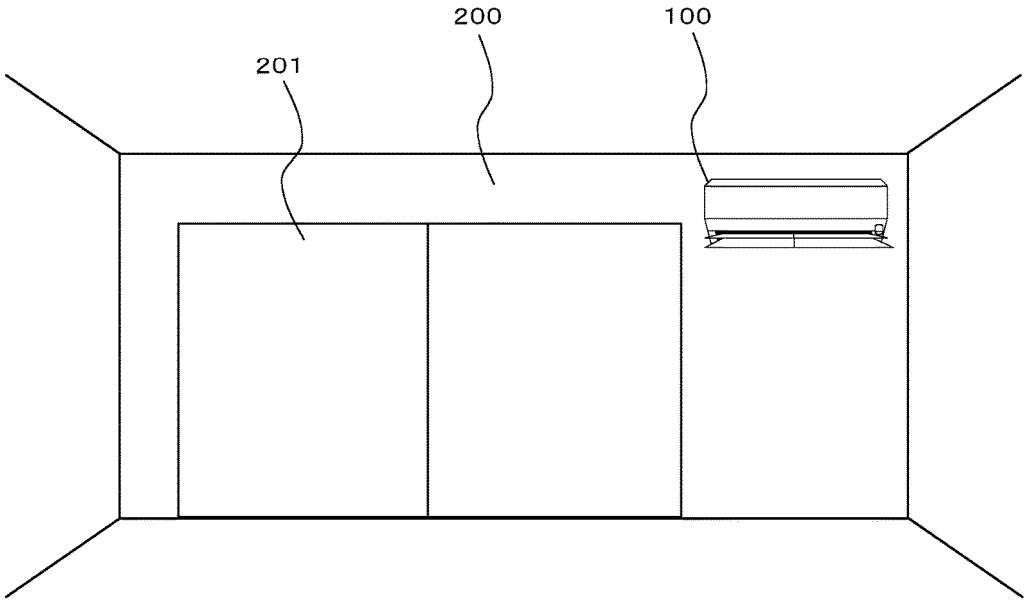
FIG. 1 is a front view illustrating an exemplary installation of an indoor unit for an air-conditioning apparatus according to an embodiment of the present invention.
Figure 2:
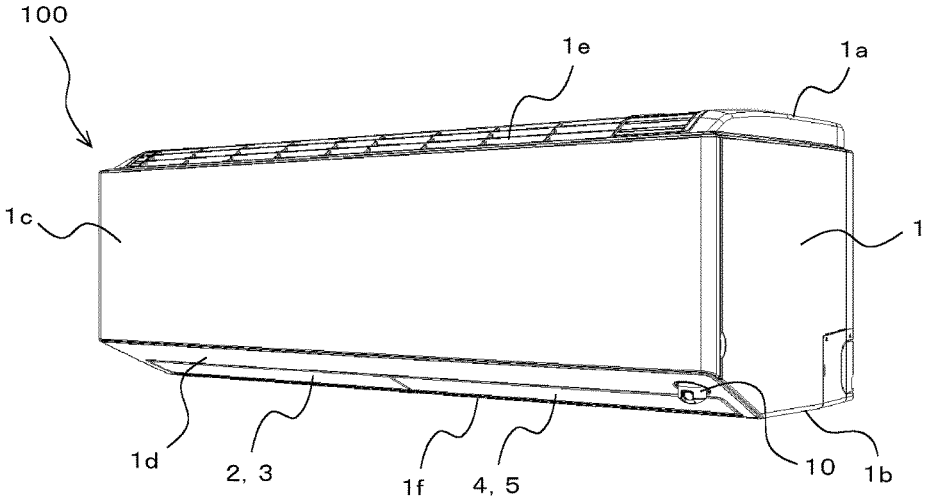
FIG. 2 is an external sensing field view illustrating the indoor unit illustrated in FIG. 1 in an enlarged manner.
Figure 3:
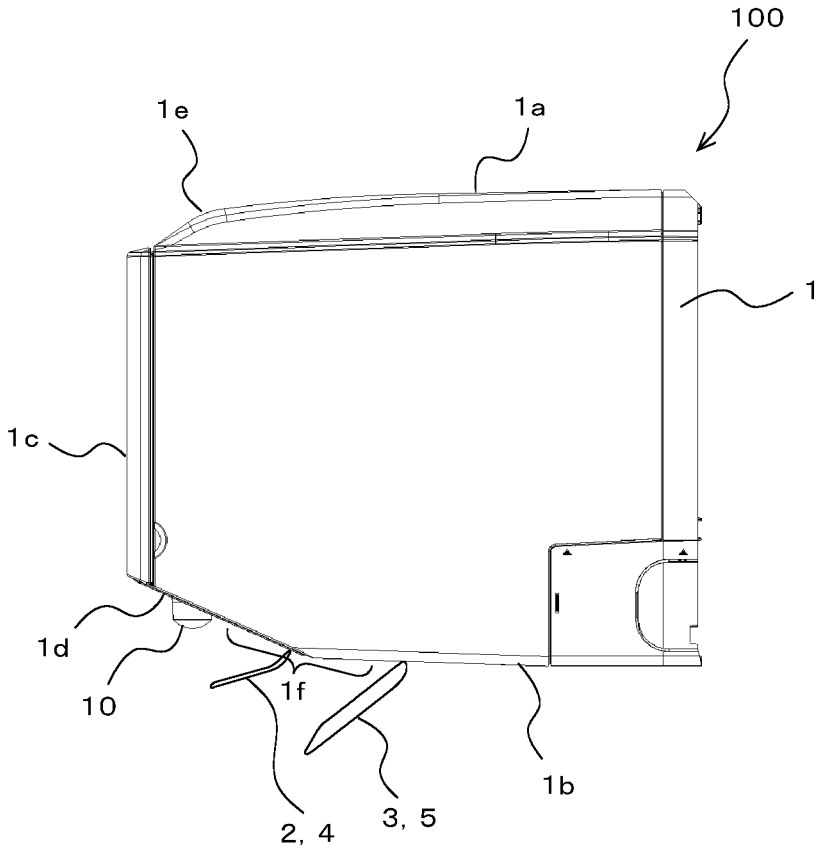
FIG. 3 is a side view of the indoor unit illustrated in FIG. 2.
Figure 4:
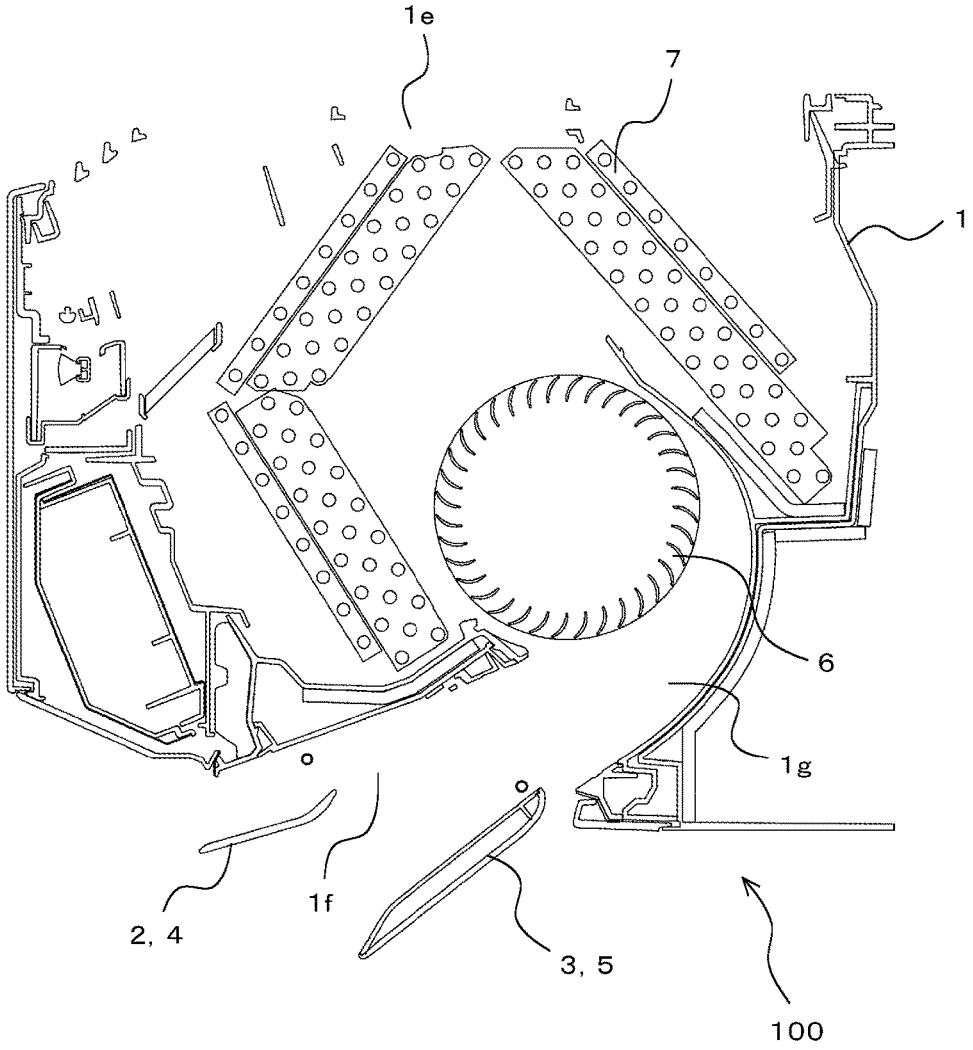
FIG. 4 is a vertical sectional view of the indoor unit illustrated in FIG. 3.
Figure 5:
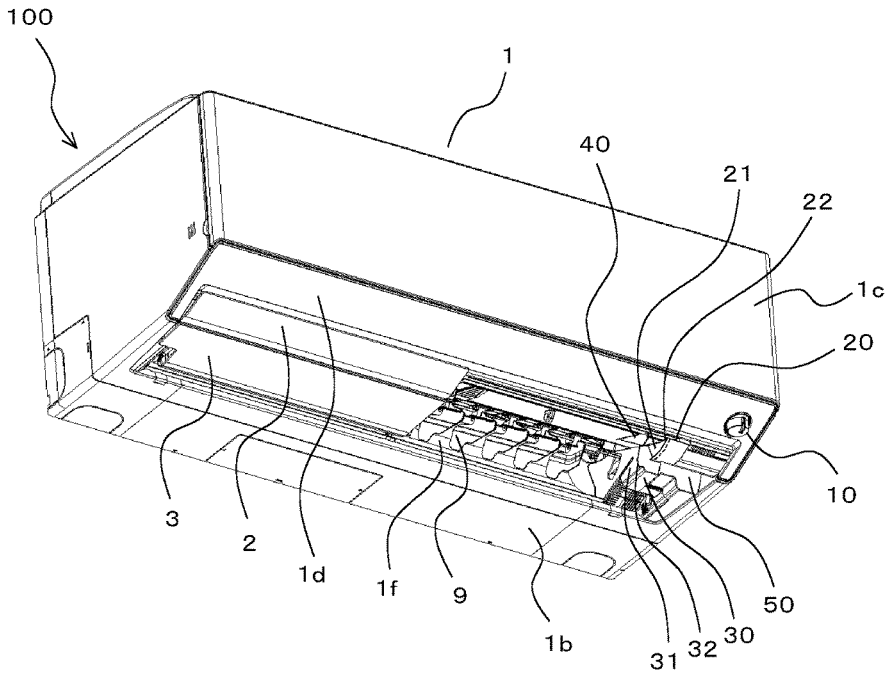
FIG. 5 is a sensing field view of the indoor unit illustrated in FIG. 2 with right vertical airflow-direction louvers having been removed.
Figure 6:
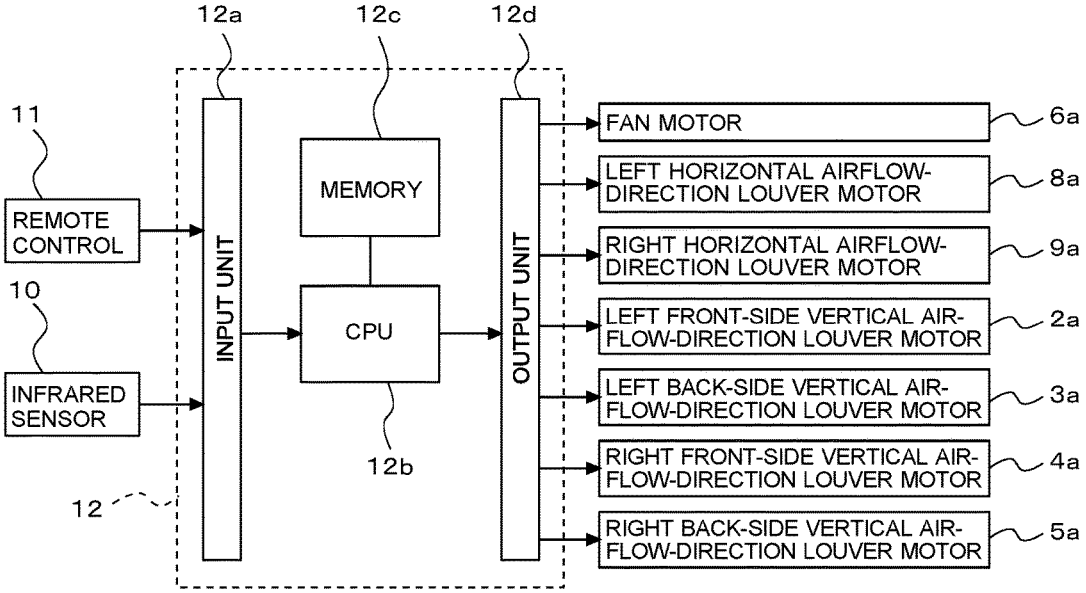
FIG. 6 is a block diagram illustrating a configuration of a controller of the indoor unit illustrated in FIG. 1.

FIG. 1 is a front view illustrating an exemplary installation of an indoor unit for an air-conditioning apparatus according to an embodiment of the present invention. FIG. 2 is an external sensing field view illustrating the indoor unit of FIG. 1 in an enlarged manner. FIG. 3 is a side view of the indoor unit illustrated in FIG. 2. FIG. 4 is a vertical sectional view of the indoor unit illustrated in FIG. 3. FIG. 5 is a sensing field view of the indoor unit illustrated in FIG. 2 with right vertical airflow-direction louvers having been removed. FIG. 6 is a block diagram illustrating a configuration of a controller of the indoor unit illustrated in FIG. 1.

As illustrated in FIG. 1, an indoor unit 100 for an air-conditioning apparatus is installed on an indoor wall surface 200 in use. The indoor unit 100 includes, as illustrated in FIG. 2 and FIG. 3, a casing 1, an air inlet 1*e*, an air outlet 1*f*, and vertical airflow-direction louvers 2, 3, 4, and 5. The casing 1 is elongated in a horizontal direction as viewed from a front. The air inlet 1*e* is formed on an upper part 1*a* of the casing 1 to take-in indoor air. The air outlet 1*f* is formed below a front part 1*c* of the casing 1 to blow conditioned air into an indoor space. The vertical airflow-direction louvers 2 and 3 are arranged over an approximately left half of the air outlet 1*f*. The vertical airflow-direction louver 2 is located on a side close to the front part 1*c* (hereinafter the side close to the front part 1*c* is referred to as "front side" or just "front", and the vertical airflow-direction louver 2 located on the left front-side is referred to as "left front-side vertical airflow-direction louver 2"). The vertical airflow-direction louver 3 is located on a side close to a lower part 1*b* (hereinafter the side close to the lower part 1*b* is referred to as "back side" or just "back, and the vertical airflow-direction louver 3 located on the left back side is referred to as "left back-side vertical airflow-direction louver 3"). The vertical airflow-direction louvers 4 and 5 are arranged over the remaining half, that is, the right half, of the air outlet 1*f*. The vertical airflow-direction louver 4 is located on the right front side (hereinafter referred to as "right front-side vertical airflow-direction louver 4"). The vertical airflow-direction louver 5 is located on the right back side (hereinafter referred to as "right back-side vertical airflow-direction louver 5").

On the front side of the lower part 1*b* of the casing 1, an inclined portion 1*d* inclined downward from the front part 1*c* in a direction toward the back side is formed. The air outlet 1*f* has, in plan view, a substantially rectangular shape elongated in the horizontal or width direction of the casing 1 and having a short side length corresponding to a distance from a part of the inclined portion 1*d* to the lower part 1*b* of the casing 1. The left front-side vertical airflow-direction louver 2 and the right front-side vertical airflow-direction louver 4 are provided to cover a half of the air outlet 1*f* on the front side. The left back-side vertical airflow-direction louver 3 and the right back-side vertical airflow-direction louver 5 are provided to cover the remaining half of the air outlet 1*f*.

As illustrated in FIG. 6, the four vertical airflow-direction louvers 2, 3, 4, and 5 pivot to change angles thereof in a vertical direction by being driven by vertical airflow-direction louver motors 2*a*, 3*a*, 4*a*, and 5*a* controlled by a controller 12. The pivoting in the vertical direction of the four vertical airflow-direction louvers 2, 3, 4, and 5 are carried out through rotary shafts respectively provided to the vertical airflow-direction louver motors 2*a*, 3*a*, 4*a*, and 5*a*.

In the above, four vertical airflow-direction louvers are provided in total, that is, the vertical airflow-direction louvers 2, 3, 4, and 5 are provided in this case. However, the number of vertical airflow-direction louvers may be two. In this case, the front-side vertical airflow-direction louver and the back-side vertical airflow-direction louver are continuous over the horizontal direction without having any division in the horizontal direction. Alternatively, the number of vertical airflow-direction louvers may be three in total. In this case, either one of the front-side vertical airflow-direction louver and the back-side vertical airflow-direction louver includes two separate vertical airflow-direction louvers. Further, only a single vertical airflow-direction louver may be provided.

Further, a first airflow blocking portion 20 and a second airflow blocking portion 30 are provided on, for example, a right end of the air outlet 1*f* to be arranged on the front side and the back side, as described later (see FIG. 5). A side wall 21 of the first airflow blocking portion 20 and a side wall 31 of the second airflow blocking portion 30, which are oriented toward the air outlet 1*f*, are located on the same plane as a right side wall of the air outlet 1*f*. In other words, the side walls 21 and 31 are both flush with each other and correspond to the right side wall of the air outlet 1*f*. Further, a baffle plate 40 is provided inside the air outlet 1*f* to locate on the upper right.

An infrared sensor 10 that projects downward from the inclined portion 1*d* is mounted to, for example, a right end of the inclined portion 1*d* of the casing 1. Specifically, the infrared sensor 10 is installed more front of the right front-side vertical airflow-direction louver 4 and higher than the right front-side vertical airflow-direction louver 4 (installed at a position close to an indoor ceiling). The infrared sensor 10 is turned by a motor (not shown). An object present just beside the indoor unit 100, on the installation wall surface 200 on which the indoor unit 100 is installed, and on a window 201 formed on the installation wall surface 200 are encompassed in a sensing field of the infrared sensor 10.

Inside the casing 1, an airflow path 1*g*, a fan 6, and a heat exchanger 7 are provided, as illustrated in FIG. 4. The airflow path 1*g* brings the air inlet 1*e* and the air outlet 1*f* into communication with each other. The fan 6 is installed in the airflow path 1*g*, and draws in the indoor air and blows the conditioned air. The heat exchanger 7 is located on an intake side of the fan 6 and exchanges heat with indoor air drawn in by the fan 6 to generate the conditioned air. Although a cross flow fan is described and illustrated as the fan 6 in this embodiment, another fan, for example, a propeller fan may be used. Further, although the fan 6 is installed on a downstream side of the heat exchanger 7, the fan 6 may also be installed on an upstream side of the heat exchanger 7.

A plurality of horizontal airflow-direction louvers (not shown) are arranged in a row at equal intervals in a left side of the air outlet 1*f* described above, whereas a plurality of horizontal airflow-direction louvers 9 are similarly arranged in the same row at equal intervals in a right side of the air outlet 1*f* (see FIG. 5). The left horizontal airflow-direction louvers are coupled to a left horizontal airflow-direction louver motor 8*a* through a link mechanism. Each of the left horizontal airflow-direction louvers pivots in the horizontal direction about a rotary shaft that is provided approximately perpendicular to an upper wall of the air outlet 1*f* or a lower wall of the air outlet 1*f*. Further, the right horizontal airflow-direction louvers 9 are coupled to a right horizontal airflow-direction louver motor 9*a* through an intermediation of a link mechanism, similarly to the left horizontal airflow-direction louvers. Each of the right horizontal airflow-direction louvers 9 variably changes an orientation in the horizontal direction about a rotary shaft that is provided approximately perpendicular to the upper wall of the air outlet 1*f* or the lower wall of the air outlet 1*f*.

Although the left horizontal airflow-direction louvers are coupled to the left horizontal airflow-direction louver motor 8*a* and the right horizontal airflow-direction louvers 9 are coupled to the right horizontal airflow-direction louver motor 9*a* in this embodiment, the left horizontal airflow-direction louvers and the right horizontal airflow-direction louvers 9 may be connected through a link mechanism so that the left horizontal airflow-direction louvers and the right horizontal airflow-direction louvers 9 are both turned in the horizontal direction by a single motor. Further alternatively, the orientation of each of the left horizontal airflow-direction louvers and the right horizontal airflow-direction louvers in the horizontal direction may be changed not by the motor but manually.

The controller 12 illustrated in FIG. 6 is, for example, a microcomputer, and is built in the indoor unit 100. The controller 12 includes an input unit 12*a*, a CPU 12*b*, a memory 12*c*, and an output unit 12*d*. The CPU 12*b* executes calculation processing, determination processing, or other processing. The memory 12*c* stores various control setting values and control programs in accordance with an operation mode such as a cooling operation mode and a heating operation mode. The output unit 12*d* outputs driving signals in accordance with output information such as the result of the calculation and the result of the determination performed in the CPU 12*b* individually to the motors 2*a*, 3*a*, 4*a*, 5*a*, 6*a*, 8*a*, and 9*a*. The input unit 12*a* receives operation information (such as the operation mode, a temperature setting, a humidity setting, air volume setting, and airflow direction setting) transmitted from a remote controller 11, and inputs the received operation information to the CPU 12*b*. Further, the input unit 12*a* receives temperature information of the indoor space, which is detected by the infrared sensor 10, and a temperature (room temperature) detected by a room-temperature thermistor (not shown) built in the casing 1, and inputs the received temperature information and the detected temperature to the CPU 12*b*. In this case, the CPU 12*b* compares and checks the temperature information (indoor space temperature distribution) and the control setting values stored in the memory 12*c* with each other based on the room temperature to obtain information about an indoor floor temperature, a wall surface temperature, a position of a human body, and an activity status of the human.

A rotation speed of the fan motor 6*a* (air volume) and rotation angles of the left horizontal airflow-direction louver motor 8*a* and the right horizontal airflow-direction louver motor 9*a* are controlled by the driving signals output from the output unit 12*d*. Further, rotation angles of the left front-side vertical airflow-direction louver motor 2*a* and the left back-side vertical airflow-direction louver motor 3*a* and rotation angles of the right front-side vertical airflow-direction louver motor 4*a* and the right back-side vertical airflow-direction louver motor 5*a* are controlled by the driving signals from the output unit 12*d*.

Figure 7:
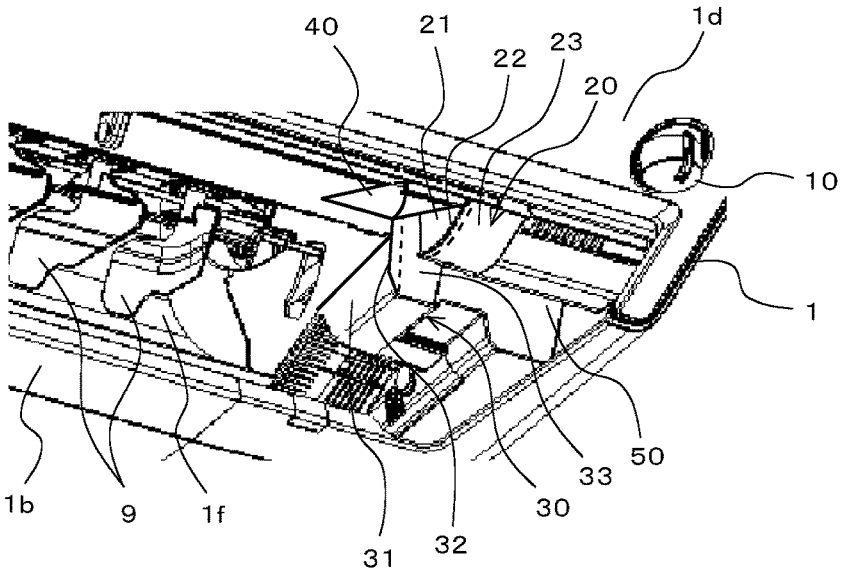
FIG. 7 is an enlarged sensing field view of a right part of an air outlet of the indoor unit illustrated in FIG. 5.
Figure 8:
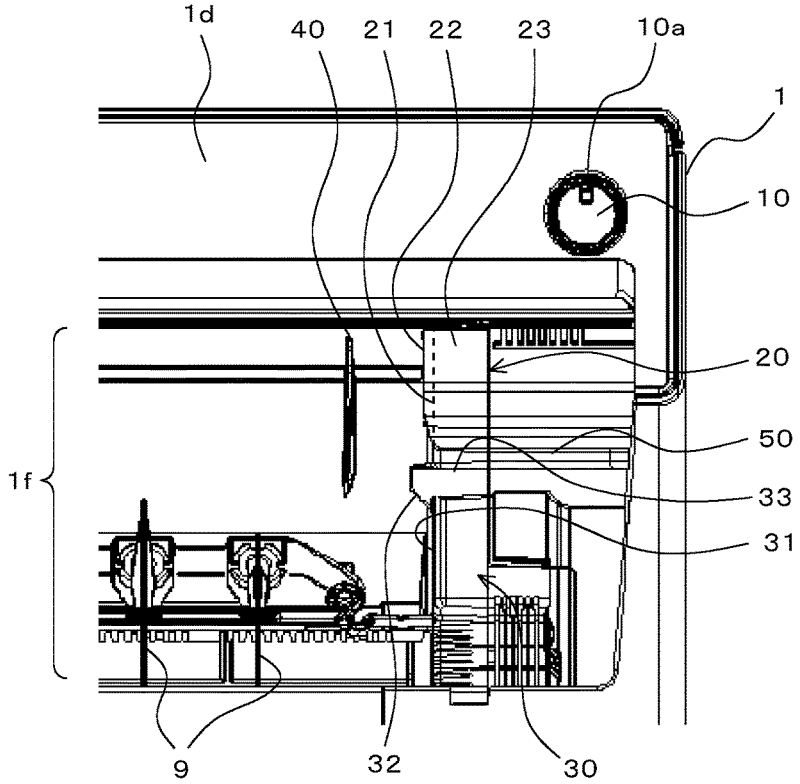
FIG. 8 is a view, from a bottom side of the casing, of the right part of the air outlet of the indoor unit illustrated in FIG. 7 as viewed from below.

Next, configurations of the first airflow blocking portion 20, the second airflow blocking portion 30, and the baffle plate 40 described above are described referring to FIG. 5, FIG. 7, and FIG. 8. FIG. 7 is a sensing field view illustrating a right part of the air outlet of the indoor unit illustrated in FIG. 5 in an enlarged manner. FIG. 8 is a bottom view of the right part of the air outlet of the indoor unit illustrated in FIG. 7 as viewed from below.

The first airflow blocking portion 20 and the second airflow blocking portion 30 described above are formed integrally with the casing 1. Each of the first airflow blocking portion 20 and the second airflow blocking portion 30 is formed in a block shape that projects downward. The first airflow blocking portion 20 is covered with the right front-side vertical airflow-direction louver 4 when the indoor unit 100 is stopped, whereas the second airflow blocking portion 30 is covered with the right back-side vertical airflow-direction louver 5 when the indoor unit 100 is stopped.

The side wall 21 of the first airflow blocking portion 20 (side wall on the right of the air outlet 1*f*) is located to be closer to a center of the air outlet 1*f* in the horizontal direction than the infrared sensor 10. Further, a first airflow deflecting wall 22 that projects toward the center of the air outlet 1*f* is formed on an edge of a front part 23 of the first airflow blocking portion 20, which is located on a side close to the side wall 21. The first airflow deflecting wall 22 is inclined from the side wall 21 toward the center of the air outlet 1*f* to be formed integrally with the edge of the front part 23.

The second airflow blocking portion 30 has the side wall 31 that is flush with the side wall 21 of the first airflow blocking portion 20, as described above. Further, a second airflow deflecting wall 32 that projects toward the center of the air outlet 1*f* is formed on an edge of a front part 33 of the second airflow blocking portion 30, which is located on a side close to the side wall 31. The second airflow deflecting wall 32 is inclined from the side wall 31 toward the center of the air outlet 1*f* to be formed integrally with the edge of the front part 33. A clearance 50 for the right front-side vertical airflow-direction louver 4 is formed between the first airflow blocking portion 20 and the second airflow blocking portion 30.

Although the side wall 21 of the first airflow blocking portion 20 and the side wall 31 of the second airflow blocking portion 30 locate on the same plane as the side wall of the air outlet 1*f* in this embodiment, the side walls 21 and 31 are not required to locate on the same plane as the side wall of the air outlet 1*f*.

Further, although the first airflow blocking portion 20 is covered with the right front-side vertical airflow-direction louver 4 and the second airflow blocking portion 30 is covered with the right back-side vertical airflow-direction louver 5 when the indoor unit 100 is stopped in this embodiment, the first airflow blocking portion 20 and the second airflow blocking portion 30 are not required to be covered with the vertical airflow-direction louvers 4 and 5. In this case, the first airflow blocking portion 20 and the second airflow blocking portion 30 are covered with a decorative panel. In such a configuration, the clearance 50 for the right front-side vertical airflow-direction louver 4, the clearance 50 being formed between the first airflow blocking portion 20 and the second airflow blocking portion 30, is not necessary.

The baffle plate 40 described above is located between the rightmost horizontal airflow-direction louver 9 of all the right horizontal airflow-direction louvers 9 and the first airflow blocking portion 20, and projects downward from the upper wall of the air outlet 1*f* at a back side of the air outlet. The baffle plate 40 is parallel to the side wall 21 of the first airflow blocking portion 20. The baffle plate 40 may be formed with angles so that an edge thereof in the downstream (front) side of the airflow is closer to the center of the air outlet than the other edge. Further, a plurality of the baffle plates 40 may be arranged in the horizontal direction of the air outlet 1*f* at intervals. In this case, at least the baffle plate 40 that is the closest to the first airflow blocking portion 20 only needs to locate between the rightmost horizontal airflow-direction louver 9 of all the right horizontal airflow-direction louvers 9 and the first airflow blocking portion 20.

An operation of the indoor unit 100 configured as described above is described referring to FIG. 9.

Figure 9:
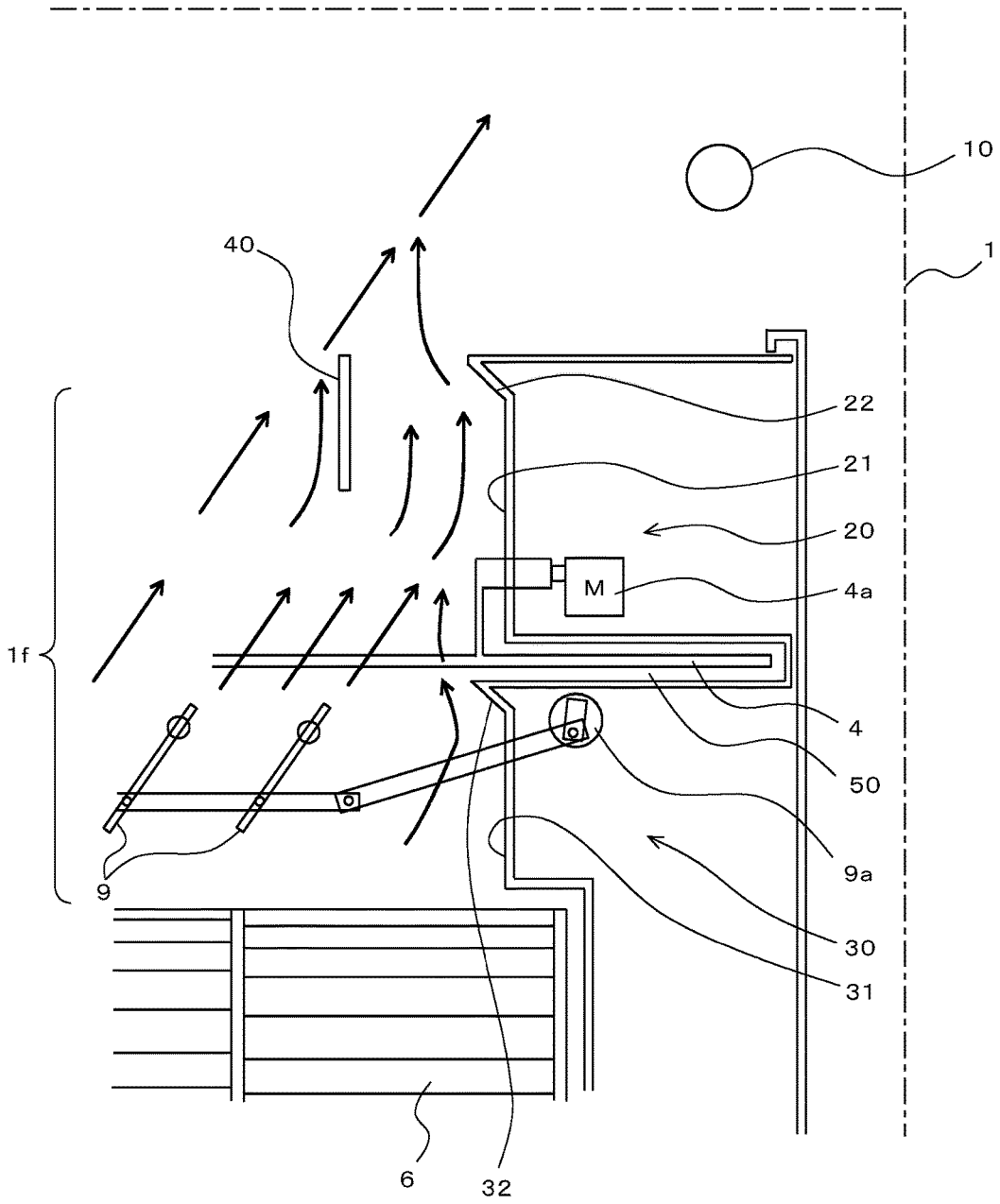
FIG. 9 is a schematic view of airflows of conditioned air from a fan in the indoor unit illustrated in FIG. 8.

FIG. 9 is a schematic view of airflows when the fan blows the conditioned air in the indoor unit illustrated in FIG. 8.

When the controller 12 starts the operation of the indoor unit 100 of the air-conditioning apparatus through input of the operation information (such as the operation mode, the temperature setting, the humidity setting, the air volume setting, and the airflow direction setting) transmitted from the remote controller 11, the four vertical airflow-direction louvers 2, 3, 4, and 5 are subjected to opening control to open the air outlet 1*f* and drive the fan motor 6*a*. At this time, the indoor air is taken into the indoor unit 100 through the air inlet 1*e*. Then, the intake indoor air exchanges heat in the heat exchanger 7 to become the conditioned air, which passes through the air outlet 1*f* and the left horizontal airflow-direction louvers and the right horizontal airflow-direction louvers 9 to be blown into the indoor space through the four vertical airflow-direction louvers 2, 3, 4, and 5.

When the temperature information of the indoor space (indoor space temperature distribution) detected by the infrared sensor 10 and the temperature (room temperature) detected by the room-temperature thermistor built in the casing 1 are input, the controller 12 compares and checks the temperature information and the control setting values stored in the memory 12*c* with each other to acquire the information about the indoor floor temperature, the wall surface temperature, the position of the human, and the activity status of the human. Then, the controller 12 generates output information necessary for the operation of the indoor unit 100 based on the acquired information and the above-mentioned operation information to control the output unit 12*d* to output the driving signals in accordance with the output information. In this case, the rotation speed of the fan motor 6*a* (air volume) is controlled and the rotation angles of the left horizontal airflow-direction louver motor 8*a* and the right horizontal airflow-direction louver motor 9*a* are controlled. Further, the rotation angles of the left front-side vertical airflow-direction louver motor 2*a*, the left back-side vertical airflow-direction louver motor 3*a*, the right front-side vertical airflow-direction louver motor 4*a*, and the right back-side vertical airflow-direction louver motor 5*a* are controller by the driving signals output from the output unit 12*d*.

Through the control described above, when the right horizontal airflow-direction louvers 9 are inclined to the right, the conditioned air from the air outlet 1*f* flows toward the first airflow blocking portion 20 and the second airflow blocking portion 30, as indicated by the arrows illustrated in FIG. 9. In this case, the conditioned air between the right-most horizontal airflow-direction louver 9 and the side wall 31 of the second airflow blocking portion 30 flows along the side wall 31 and is then guided to a front side of the air outlet 1*f* by the second airflow deflecting wall 32. Further, the conditioned air flows along the side wall 21 of the first airflow blocking portion 20 and is guided toward the center of the air outlet 1*f* by the first airflow deflecting wall 22. In this case, the conditioned air is prevented from staying in the clearance 50 and flowing therefrom toward the infrared sensor 10 by the second airflow deflecting wall 32.

Further, the conditioned air between the horizontal airflow-direction louvers 9 is introduced by the conditioned air that is guided forward (to the front side) by the second airflow deflecting wall 32, to flow toward the center of the air outlet 1*f* without flowing in a direction toward the infrared sensor 10. Further, the direction of airflow of the conditioned air between the horizontal airflow-direction louvers 9 is changed to the front side by the baffle plate 40. The conditioned air flowing in an area away from the infrared sensor 10 blows in accordance with the orientations of the four vertical airflow-direction louvers 2, 3, 4, and 5, the left horizontal airflow-direction louvers (not shown), and the right horizontal airflow-direction louvers 9 without being affected by the first airflow blocking portion 20, the second airflow blocking portion 30, and the baffle plate 40.

As described above, in this embodiment, the airflow of the conditioned air is directed away from the infrared sensor 10 by the first airflow blocking portion 20, the second airflow blocking portion 30, and the baffle plate 40. Therefore, a sensor cover that covers the infrared sensor 10 is allowed to have a temperature approximately equal to the room temperature. Hence, the infrared sensor can detect a precise amount of infrared ray without being disturbed by the temperature of the sensor cover. Accordingly, the infrared sensor can obtain precise information about a floor temperature, a wall surface temperature, a position of a human body, and an activity status of the human.

Further, the infrared sensor 10 projects downward from the right end of the inclined portion 1*d* of the casing 1. Therefore, the sensing field of the infrared sensor 10 is not interrupted by the vertical airflow-direction louvers 2, 3, 4, and 5 and the casing 1 itself. With this configuration, an extended range of detection by the infrared sensor 10 results.

Further, even when the vertical airflow-direction louvers 2, 3, 4, and 5 are closed, the infrared sensor 10 is exposed. Thus, indoor space information can be obtained even when the indoor unit 100 is stopped. Thus, for example, the operation can be automatically started in accordance with conditions of the indoor space.

The infrared sensor 10 is provided turnably on the right end of the inclined portion 1*d* of the casing 1. Therefore, an object just beside the indoor unit 100, the installation wall surface 200 on which the indoor unit 100 is installed, and the window 201 formed on the installation wall surface 200 can be included in the range of detection by the infrared sensor 10. Thus, precise indoor information can be obtained, while the air volume and the airflow direction of the conditioned air can be controlled using an increased amount of indoor information.

Although the infrared sensor 10 is provided on the inclined portion 1*d* to locate on the right end of the casing 1 in this embodiment, the infrared sensor 10 may be provided on the inclined portion 1*d* to locate on a left end of the casing 1 instead. In this case, the first airflow blocking portion 20 and the second airflow blocking portion 30 are provided on the left end of the air outlet 1*f* so that the conditioned air blowing from the air outlet 1*f* does not blow on the infrared sensor 10.

REFERENCE SIGNS LIST

1 casing 1*a* upper part 1*b* lower part 1*c* front part 1*d* inclined portion 1*e* air inlet 1*f* air outlet 1*g* airflow path 2 left front-side vertical airflow-direction louver 2*a* left front-side vertical airflow-direction louver motor 3 left back-side vertical airflow-direction louver 3*a* left back-side vertical airflow-direction louver motor 4 right front-side vertical airflow-direction louver 4*a* right front-side vertical airflow-direction louver motor 5 right back-side vertical airflow-direction louver 5*a* right back-side vertical airflow-direction louver motor 6 fan 6*a* fan motor 7 heat exchanger 8*a* left horizontal airflow-direction louver motor 9 right horizontal airflow-direction louver 9*a* right horizontal airflow-direction louver motor 10 infrared sensor 11 remote controller 12 controller 12*a* input unit 12*b* CPU 12*c* memory 12*d* output unit 20 first airflow blocking portion 21 side wall 22 first airflow deflecting wall 23 front part 30 second airflow blocking portion 31 side wall 32 second airflow deflecting wall 33 front part baffle plate 50 clearance 100 indoor unit 200 wall surface (installation wall surface) 201 window

The invention claimed is:

1. An indoor unit for an air-conditioning apparatus, comprising:

a casing having an air inlet formed in an upper part of the casing and an air outlet formed below a front part of the casing, the casing accommodating therein a heat exchanger and a fan;

at least one horizontal airflow-direction louver mounted pivotally inside the air outlet to guide airflow through the air outlet in a horizontally changeable manner;

at least one vertical airflow-direction louver mounted to cover the air outlet in a closed position and to guide airflow through the air outlet in a vertically changeable manner;

an infrared sensor projecting downward from the casing at a position in a horizontal end portion of the casing and between the air outlet and the front part of the casing; and at least one airflow blocking portion which projects downward from a bottom of the casing, the at least one airflow blocking portion is located between (a) a downward projecting portion of the infrared sensor which projects downward from the bottom of the casing and (b) the air outlet, the at least one airflow blocking portion having a side wall on or beside one edge of the air outlet, the side wall of the at least one airflow blocking portion being located closer to a center of the air outlet in the horizontal direction than the infrared sensor is located to the center of the air outlet.

2. The indoor unit of claim 1, wherein the at least one vertical airflow-direction louver includes two separate vertical airflow-direction louvers provided respectively in front and back of the air outlet.

3. The indoor unit of claim 2, wherein the at least one airflow blocking portion includes two airflow blocking portions arranged in a direction from front to back, one of the two airflow blowing portions disposed in the front being a first airflow blocking portion, an other one of the two airflow blocking portions disposed in the back being a second airflow blocking portion, the first airflow blocking portion includes a side wall provided with the airflow deflecting wall, the second airflow blocking portion includes a side wall provided with the airflow deflecting wall, a clearance extending in the horizontal direction is formed between the first airflow blocking portion and the second airflow blocking portion, one of the two vertical airflow-direction louvers provided in the front is accommodated in the clearance when the one of the two vertical airflow-direction louvers provided in the front opens the air outlet.

4. The indoor unit of claim 1, wherein the at least one vertical airflow-direction louver includes two separate vertical airflow-direction louvers positioned respectively in front and back of the air outlet, one of the airflow-direction louvers including two separate vertical airflow-direction louvers positioned side by side in the horizontal direction.

5. The indoor unit of claim 1, wherein the at least one vertical airflow-direction louver includes two separate vertical airflow-direction louvers positioned respectively in front and back of the air outlet, the two separate vertical airflow-direction louvers each including two separate vertical airflow-direction louvers positioned side by side in the horizontal direction.

6. The indoor unit of claim 1, further comprising an airflow deflecting wall provided to the side wall of the at least one airflow blocking portion, the airflow deflecting wall being configured to deflect, away from the infrared sensor, airflow directed to the side wall at least by the horizontal airflow-direction louver.

7. The indoor unit of claim 1, further comprising at least one baffle plate projecting downward from an upper wall of the air outlet, the baffle plate being provided between the side wall of the at least one airflow blocking portion and one of the at least one horizontal airflow-direction louver located on an end close to the side wall of the at least one airflow blocking portion.

8. The indoor unit of claim 7, wherein the at least one baffle plate includes a plurality of baffle plates arranged in the horizontal direction with spacing from one another in the air outlet.

* * * * *